US005760541A

United States Patent [19]

Stavely et al.

[11] Patent Number: 5,760,541

[45] Date of Patent: Jun. 2, 1998

[54] ELECTRODE FOR EXTERNAL ELECTRODE FLUORESCENT LAMP PROVIDING IMPROVED LONGITUDINAL STABILITY OF INTENSITY STRIATIONS

[75] Inventors: Donald James Stavely, Fort Collins; Oscar R. Herrera E., Greeley, both of Colo.

[73] Assignee: Hewlett-Packard Company, Palo Alto, Calif.

[21] Appl. No.: 606,618

[22] Filed: Feb. 26, 1996

[51] Int. Cl.[6] ..... H01J 1/62; H01J 63/04; H01J 11/00; H01J 61/06

[52] U.S. Cl. ..... 313/491; 313/607; 313/493; 313/634

[58] Field of Search ..... 313/491–493, 313/607, 631, 632, 633, 634

[56] References Cited

U.S. PATENT DOCUMENTS

| | | | |
|---|---|---|---|
| 3,493,763 | 2/1970 | Hannappel | 313/607 X |
| 4,887,002 | 12/1989 | Dobasi et al. | 313/607 |
| 5,013,966 | 5/1991 | Saikatsu et al. | 313/493 |
| 5,101,330 | 3/1992 | Suzuki | 313/607 |
| 5,117,160 | 5/1992 | Konda et al. | 313/607 X |
| 5,514,934 | 5/1996 | Matsumoto et al. | 313/607 |

*Primary Examiner*—Sandra L. O'Shea
*Assistant Examiner*—Mack Haynes
*Attorney, Agent, or Firm*—Augustus W. Winfield

[57] ABSTRACT

An electrode for an external electrode fluorescent lamp. The lamp has intensity striations. The electrode has a periodic non-uniform area sufficient to cause a periodic non-uniformity in the electric field between two electrodes. The non-uniformity of the electric field is sufficient to prevent wandering of the striations. The striations have a range of pitch. The pitch of the area in the electrode is within the range of pitch of the intensity striations. Examples of non-uniform areas include serrated or sinusoidal edges and circumferential slits.

4 Claims, 6 Drawing Sheets

ELECTRODE FOR EXTERNAL ELECTRODE FLUORESCENT LAMP PROVIDING IMPROVED LONGITUDINAL STABILITY OF INTENSITY STRIATIONS

FIELD OF INVENTION

This invention relates generally to external electrode fluorescent lamps and more specifically to improvement in stability of light and dark regions along the length of a lamp.

BACKGROUND OF THE INVENTION

Fluorescent lamps of the type typically used for household and office lighting have internal electrodes. Heating the electrodes causes thermoionic emission of electrons. Providing a high voltage from one electrode to the other causes electron flow between the electrodes. The electrons then excite mercury atoms. The excited mercury atoms release their acquired energy in the form of ultraviolet radiation. The ultraviolet radiation excites a phosphor coating on the interior of the lamp, resulting in emission of visible light.

An alternative fluorescent lamp design places parallel plate electrodes along the exterior surface of the lamp. Voltage applied to the electrodes causes polarization of the interior surface of the lamp envelope, resulting in electron flow across the diameter of the tube rather than from one end of the tube to the other. In a commercially available external electrode lamp, xenon is used instead of mercury. Electron collisions with xenon atoms result in emission of ultraviolet light. The ultraviolet light excites a phosphor coating on the interior of the lamp resulting in emission of visible light. A commercially available example of an external electrode lamp is part number CFX12AYG/36H available from NEC Electronics, Inc.

Compared to lamps having internal hot cathodes, lamps having external electrodes have a relatively longer life. There are also other advantages, including simplified wiring, vibration and shock resistance, and stable ambient temperature characteristics. External electrode fluorescent lamps are typically used in applications such as copiers and scanners. Prior art external electrode fluorescent lamps, however, have a characteristic that is unsuitable for some scanner applications. The lamps exhibit intensity striations (light and dark intensity bands). In addition, for prior art lamp designs, the intensity striations randomly wander longitudinally along the lamp. In applications such as copiers and facsimile machines, light is diffused by the surface of the opaque medium being scanned so that small local light intensity variations are relatively unimportant. In transparency scanners, however, the transparent medium being scanned does not diffuse the light, so light intensity variation becomes a problem. Electronic compensation can reduce the effects of a consistent variation in light intensity but measurement and compensation for time variable intensity variation, especially random or sporadic variation, is more difficult and expensive. There is a need for an improved lamp in which the intensity variations are minimized or at least stationary.

SUMMARY OF THE INVENTION

In the invention, the external electrodes are modified to provide patterns of strong and weak electric fields. Discharge arcs then favor the strong field regions and do not wander outside the limited strong field regions. The pitch or periodicity of the pattern for each embodiment is chosen to be within the range of natural periodicity for intensity striations for the particular lamp design. Suitable electrode shape patterns include serrated or sinusoidal edges and circumferential slits.

DETAILED DESCRIPTION OF THE PREFERRED EMBODIMENT OF THE INVENTION

Figure 1:
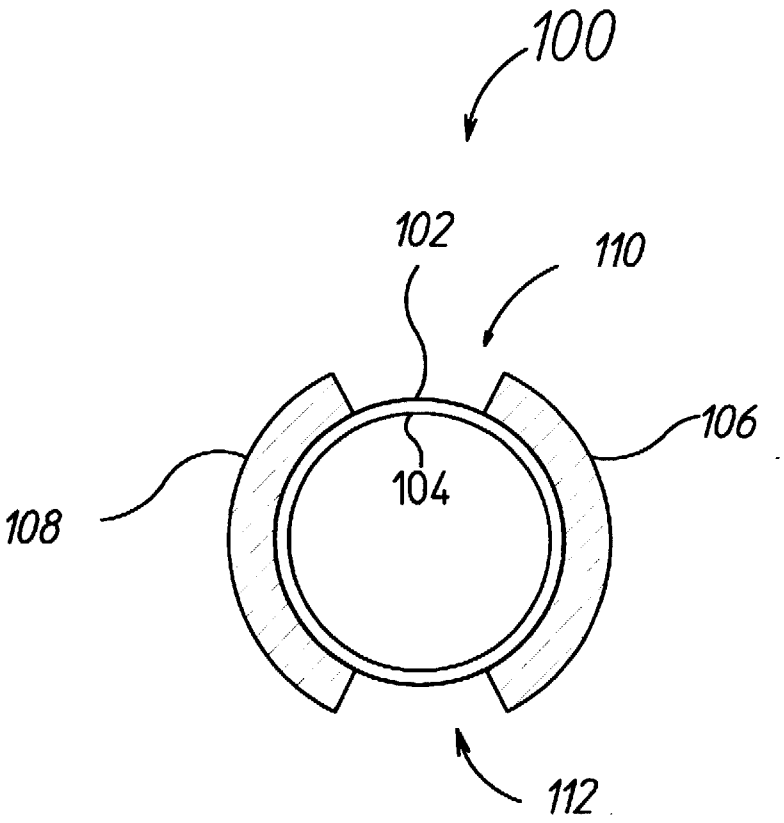
FIG. 1 is a cross-section end view of a external electrode fluorescent lamp.

FIG. 1 illustrates a cross-section of a lamp 100. A cylindrical glass envelope 102 is coated on the interior with a phosphor 104. Conductive electrodes 106 and 108 reside on the exterior of the glass envelope 102. Voltage applied to the electrodes 106 and 108 causes polarization of the interior surface of the lamp envelope, resulting in a field within the volume of the envelope between the electrodes and a discharge (electron flow) across the diameter of the tube. Electron collisions with xenon atoms result in emission of ultraviolet light. The ultraviolet light excites a phosphor coating on the interior of the lamp resulting in emission of visible light. Visible light escapes through openings 110 and 112 between the conductive electrodes 106 and 108.

Figure 2:
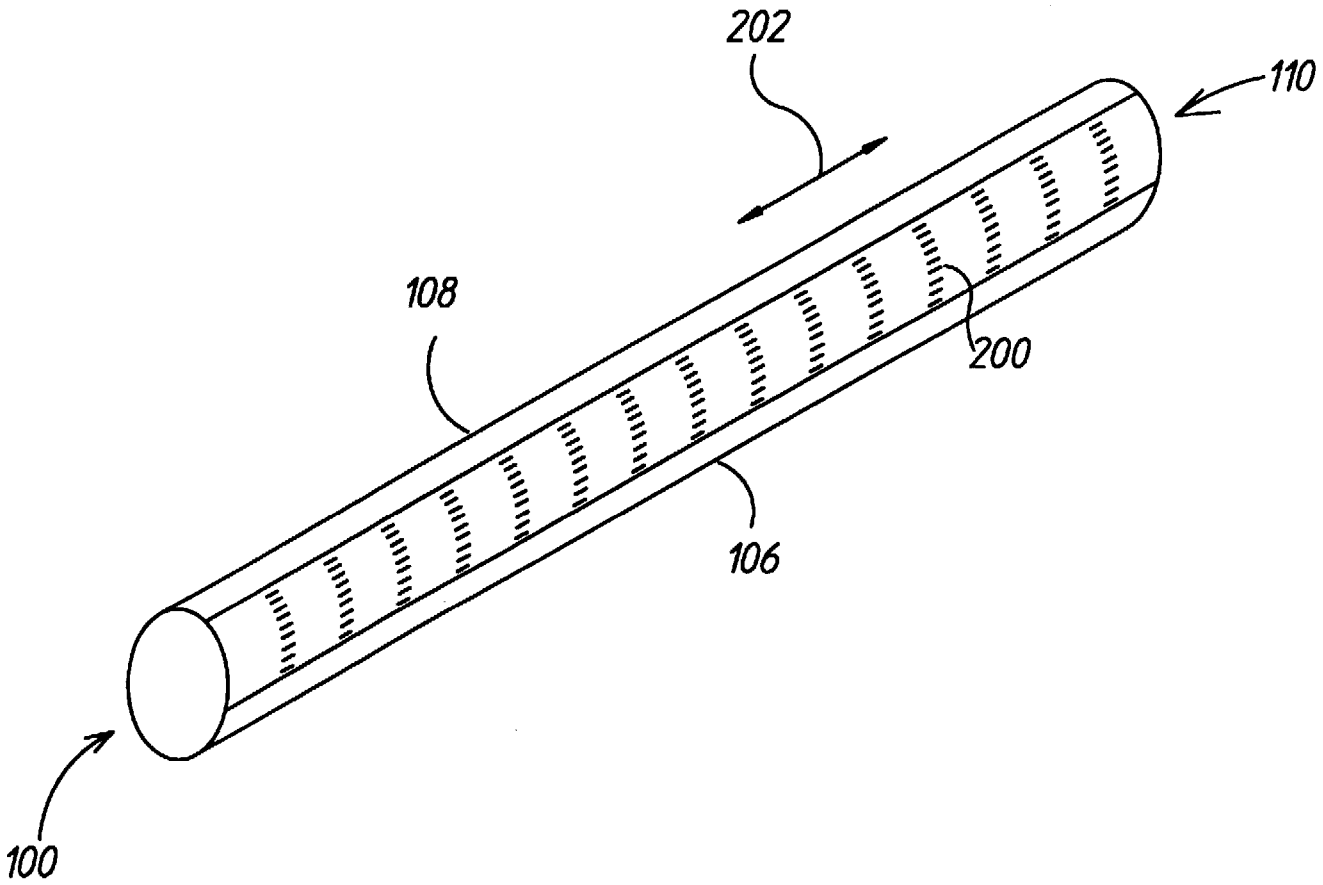
FIG. 2 is a perspective view of the lamp of FIG. 1 illustrating intensity striations.

FIG. 2 is a perspective view of the lamp 100 of FIG. 1, illustrating electrodes 106 and 108 and gap 110. The intensity along the length of the tube 100 has an approximately periodic ripple, resulting in bands or striations of relatively bright or dark intensity as indicated by reference number 200. The striations 200 wander or erratically jump along the length of the tube 100 in the direction indicated by arrow 202. In a specific commercially available lamp, the intensity variations exceed 3% of the average intensity and the pitch of the striations is 3–5 mm.

Figure 3A:
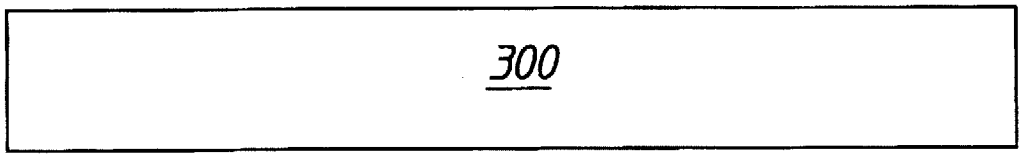
FIG 3A (PRIOR ART)
FIG. 3A is a plane view of a prior art electrode shape.
Figure 3B:
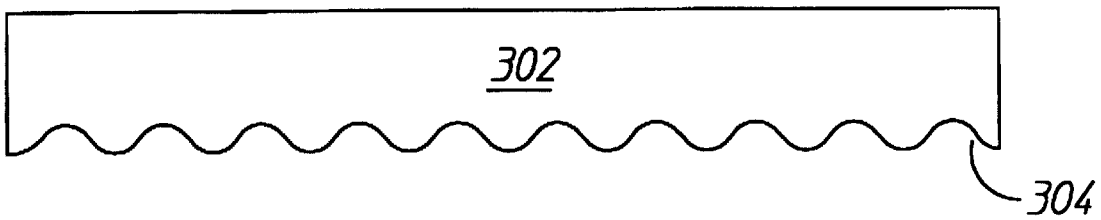
FIG. 3B is a plane view of an electrode shape in accordance with the invention.
Figure 3C:
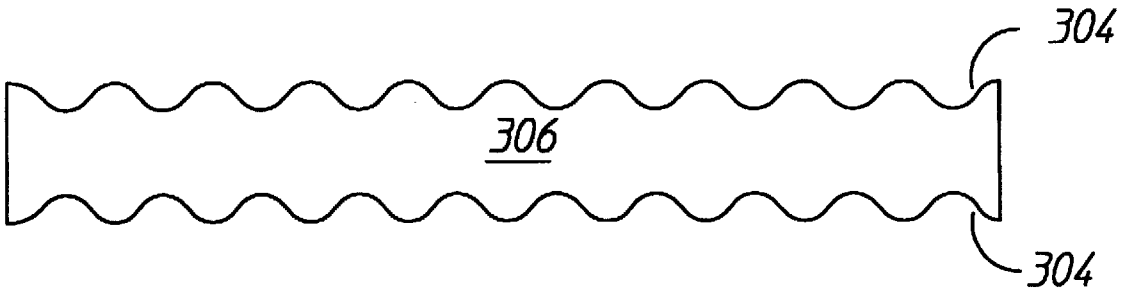
FIG. 3C is a plane view of an alternative electrode shape in accordance with the invention.
Figure 3D:
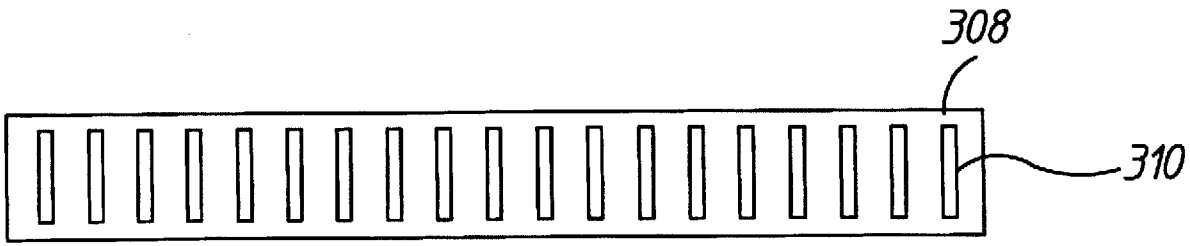
FIG. 3D is a plane view of an alternative electrode shape in accordance with the invention.

FIG. 3A illustrates a plane view of a prior art external electrode 300, as in electrodes 106 or 108 in FIGS. 1 and 2. The prior art electrodes are uniform, resulting in a uniform electric field in the volume of the envelope between the electrodes. A goal of the invention is to create a periodic longitudinal non-uniformity in the electric field between the electrodes to provide a stabilizing force for striations. That is, striations may still form, but they will not wander outside the bounds of a local field non-uniformity. FIGS. 3B–3D illustrate 3 alternative electrode shapes providing suitable periodic non-uniformity in the electric field. In FIG. 3B, electrode 302 has one serrated or sinusoidal edge 304. The pitch of the peaks is within the range of the periodicity of the striations. For example, for the lamp in which striation pitch is 3–5 mm, the pitch of the peaks in the serrated or sinusoidal edge 304 is about 4 mm. In a specific embodiment, the width of the electrode is 8 mm (straight edge to peak of serrations) and the height (peak to valley) of the "teeth" in the serrated edge is 2 mm.

Electrode 306 in FIG. 3C has serrated or sinusoidal edges 304 along both longitudinal edges. Although this provides more of a variation in the electric field, empirical evidence suggests that serrated edges on both longitudinal edges are not necessary. In addition, empirical evidence indicates that lamp intensity varies with electrode area. When part of the area is reduced, by serrations or slits as discussed below, the intensity of the lamp is reduced. Serrations along one edge as discussed above result in a reduced lamp intensity of about 10%. Therefore, serrations on a single edge are preferred, providing sufficient stability with an acceptable reduction of intensity.

Electrode 308 in FIG. 3D is provided with circumferential slits 310, again with a pitch within the range of the pitch of the intensity striations. The slits are sufficient to cause a periodic non-uniformity in the electric field between the electrodes.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A fluorescent lamp comprising:

an envelope having a first end and a second end and a longitudinal axis connecting the first end to the second end;

first and second electrodes external to the envelope, the first and second electrodes extending axially along the envelope with a gap along the length of the envelope that is not covered by either electrode, the first and second electrodes adapted to provide an electric field transverse to the axis of the envelope between the first and second electrodes; and the first electrode having an area per unit length that is non-uniform.

2. The fluorescent lamp of claim 1 further comprising:

the fluorescent lamp exhibiting intensity striations, the intensity striations having a range of pitch; and the first electrode having a width that is variable, the width of the electrode varying periodically, with a uniform period within the range of pitch of the intensity striations.

3. The fluorescent lamp of claim 2 further comprising:

the first electrode having a first edge, extending axially along the envelope, the first edge being linear; and the first electrode having a second edge, extending axially along the envelope, the second edge defining periodic peaks in the width of the first electrode.

4. The fluorescent lamp of claim 1 further comprising:

the fluorescent lamp exhibiting intensity striations, the intensity striations having a range of pitch; and the first electrode having circumferential slits repeating along a direction transverse to the intensity striations, the circumferential slits having a uniform pitch, the pitch of the circumferential slits being within the range of pitch of the intensity striations.

* * * * *